US007723004B2

(12) United States Patent
Sacripante et al.

(10) Patent No.: US 7,723,004 B2
(45) **Date of Patent: *May 25, 2010**

(54) ULTRA LOW MELT TONERS COMPRISED OF CRYSTALLINE RESINS

(75) Inventors: Guerino G. Sacripante, Oakville (CA); Ke Zhou, Mississauga (CA); Michael S. Hawkins, Cambridge (CA); Kimberly D. Nosella, Mississauga (CA); Edward G. Zwartz, Mississauga (CA); Nicoleta D. Mihai, Oakville (CA); Valerie M. Farrugia, Oakville (CA); Stephan V. Drappel, Toronto (CA); Paul J. Gerroir, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/353,863

(22) Filed: Jan. 14, 2009

(65) Prior Publication Data

US 2009/0123864 A1 May 14, 2009

Related U.S. Application Data

(63) Continuation of application No. 11/089,149, filed on Mar. 25, 2005, now Pat. No. 7,494,757.

(51) Int. Cl.
*G03G 9/087* (2006.01)

(52) U.S. Cl. ..... 430/109.4; 430/110.3; 430/111.4

(58) Field of Classification Search ..... 430/109.4, 430/111.4, 137.1, 110.3, 137.14
See application file for complete search history.

(56) References Cited

U.S. PATENT DOCUMENTS

| | | | | |
|---|---|---|---|---|
| 4,254,207 | A | 3/1981 | Landoll et al. | |
| 4,385,107 | A | 5/1983 | Tanaka et al. | |
| 4,952,477 | A | 8/1990 | Fuller et al. | |
| 4,990,424 | A | 2/1991 | Van Dusen et al. | |
| 5,057,392 | A | 10/1991 | McCabe et al. | |
| 5,147,747 | A | 9/1992 | Wilson | |
| 5,166,026 | A | 11/1992 | Fuller et al. | |
| 5,278,020 | A | 1/1994 | Grushkin et al. | |
| 5,290,654 | A | 3/1994 | Sacripante et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,364,729 | A | 11/1994 | Kmiecik-Lawrynowicz et al. | |
| 5,370,963 | A | 12/1994 | Patel et al. | |
| 5,403,693 | A | 4/1995 | Patel et al. | |
| 5,418,108 | A | 5/1995 | Kmiecik-Lawrynowicz et al. | |
| 6,383,705 | B2 | 5/2002 | Aoki et al. | |
| 6,395,442 | B1 | 5/2002 | Hayashi et al. | |
| 6,413,691 | B2 | 7/2002 | Daimon et al. | |
| 6,472,117 | B1 | 10/2002 | Kohyama et al. | |
| 6,830,860 | B2 | 12/2004 | Sacripante et al. | |
| 7,494,757 | B2 * | 2/2009 | Sacripante et al. | 430/137.1 |
| 2002/0037468 | A1 | 3/2002 | Matsushima et al. | |
| 2004/0142266 | A1 | 7/2004 | Sacripante et al. | |

FOREIGN PATENT DOCUMENTS

| | | |
|---|---|---|
| EP | 1 441 260 | 7/2004 |
| JP | 11-249339 A | 9/1999 |
| JP | 2004-226569 A | 8/2004 |

* cited by examiner

*Primary Examiner*—Janis L Dote
(74) *Attorney, Agent, or Firm*—Oliff & Berridge, PLC

(57) ABSTRACT

A toner having an amorphous resin, a crystalline resin, and a colorant, wherein the crystalline resin has a melting temperature of at least 70° C. and a recrystallization point of at least 47° C. exhibits improved document offset properties and improved heat cohesion. Annealing the toner further improves the heat cohesion and morphology of the toner.

15 Claims, No Drawings

ULTRA LOW MELT TONERS COMPRISED OF CRYSTALLINE RESINS

BACKGROUND

This is a Continuation of application Ser. No. 11/089,149, filed Mar. 25, 2005. The entire disclosure of the prior application is hereby incorporated by reference herein.

The present disclosure relates generally to a toner comprising a binder and at least one colorant, wherein the binder is comprised of an amorphous resin and a crystalline sulfonated polyester resin. In particular, the crystalline resin has a melting point of at least 70° C., and a re-crystallization point of at least 47° C.

Toners useful for xerographic applications should possess certain properties related to storage stability and particle size integrity. That is, it is desired to have the particles remain intact and not agglomerate until they are fused on paper. Since environmental conditions vary, the toners also should not substantially agglomerate up to a temperature of from about 50° C. to about 55° C.

The toner composite of resin and colorant should also display acceptable triboelectrification properties which vary with the type of carrier or developer composition. A valuable toner attribute is the relative humidity sensitivity ratio, that is, the ability of a toner to exhibit similar charging behavior at different environmental conditions such as high humidity or low humidity. Typically, the relative humidity sensitivity of toners is considered as the ratio between the toner charge at 80 percent humidity divided by the toner charge at 20 percent humidity. Acceptable values for relative humidity sensitivity of toner vary, and are dependant on the xerographic engine and the environment. Typically, the relative humidity sensitivity ratio of toners is expected to be at least 0.5 and preferably 1.

Another important property for xerographic toner compositions is fusing property on paper. Due to energy conservation measures, and more stringent energy characteristics placed on xerographic engines, such as on xerographic fusers, there is pressure to reduce the fixing temperatures of toners onto paper, such as achieving fixing temperatures of from about 90° C. to about 110° C., to permit less power consumption and allowing the fuser system to possess extended lifetimes.

For a contact fuser, that is, a fuser which is in contact with the paper and the image, the toner should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Another desirable characteristic of a toner is sufficient release of the paper image from the fuser roll. For oil containing fuser rolls, the toner may not contain a wax. However, for fusers without oil on the fuser (usually hard rolls), the toner will usually contain a lubricant like a wax to provide release and stripping properties. Thus, a toner characteristic for contact fusing applications is that the fusing latitude, that is, the temperature difference between the fixing temperature and the temperature at which the toner offsets onto the fuser, should be from about 30° C. to about 90° C., and preferably from about 50° C. to about 90° C.

Additionally, depending on the xerographic applications, other toner characteristics may be desired, such as providing high gloss images, such as from about 60 to about 80 Gardner gloss units, especially in pictorial color applications. Other toner characteristics relate to nondocument offset, that is, the ability of paper images not to transfer onto adjacent paper images when stacked up, at a temperature of about 55° C. to about 60° C.; nonvinyl offset properties; high image projection efficiency when fused on transparencies, such as from about 75 to 100 percent projection efficiency and preferably from about 85 to 100 percent projection efficiency. The projection efficiency of toners can be directly related to the transparency of the resin utilized, and clear resins are desired.

Additionally, small sized toner particles, such as from about 3 to about 12 microns, and preferably from about 5 to about 7 microns, are desired, especially in xerographic engines wherein high resolution is a characteristic. Toners with the aforementioned small sizes can be economically prepared by chemical processes, also known as direct or "in situ" toner process, and which process involves the direct conversion of emulsion sized particles to toner composites by aggregation and coalescence, or by suspension, microsuspension or microencapsulation processes.

Low fixing toners comprised of semicrystalline resins are known, such as those disclosed in U.S. Pat. No. 5,166,026. There, toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of a semicrystalline polyolefin and copolymers thereof with a melting point of from about 50° C. to about 100° C. and pigment particles are disclosed. Although it is indicated that some of these toners may provide low fixing temperatures of about 200° F. to about 225° F. using contact fusing applications, the resins are derived from components with melting characteristics of about 30° C. to about 50° C. These resins are not believed to exhibit more desirable melting characteristics, such as about 55° C. to about 60° C.

In U.S. Pat. No. 4,990,424, toners comprised of a blend of resin particles containing styrene polymers or polyesters, and components selected from the group consisting of a semicrystalline polyolefin and copolymers thereof with a melting point of from about 50° C. to about 100° C., are disclosed. Fusing temperatures of from about 250° F. to about 330° F. are reported.

Low fixing crystalline based toners are disclosed in U.S. Pat. No. 6,413,691. There, a toner comprised of a binder resin and a colorant, the binder resin containing a crystalline polyester containing a carboxylic acid of two or more valences having a sulfonic acid group as a monomer component, are illustrated.

Crystalline based toners are disclosed in U.S. Pat. No. 4,254,207. Low fixing toners comprised of crosslinked crystalline resin and amorphous polyester resin are illustrated in U.S. Pat. No. 5,147,747 and U.S. Pat. No. 5,057,392. In each, the toner powder is comprised, for example, of polymer particles of partially carboxylated crystalline polyester and partially carboxylated amorphous polyester that has been crosslinked together at an elevated temperature with the aid of an epoxy novolac resin and a crosslinking catalyst.

Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108 and 5,364,729.

Also of interest may be U.S. Pat. Nos. 6,830,860, 6,383,705 and 4,385,107, the disclosures of which are totally incorporated herein by reference.

Existing low melt toners do not meet the heat cohesion requirements when no external additives are added to the toner. The heat cohesion of known low melt toners with no additives is generally greater than 77%. Low melt toners without additives and a heat cohesion of less than 20% are particularly robust. Thus, it is preferred that low melt toners having no external additives have a heat cohesion of less than 20%, and more preferably less than 10%. For comparison, low melt toners having external additives have a heat cohesion of less than 10%.

Toners with low heat cohesion have desired flow characteristics and resist agglomeration or fusing before actually being imaged and fused. Toners must have fluidity or good powder flow such that they are properly imaged in copier/printers. After a toner is manufactured, packaged and shipped, it may encounter temperature variations in environment typically up to 40° C. and in extreme cases as high as 50° C. Under such conditions, if the particle starts to flow (i.e., melt), the particle will stick to other particles and agglomerate and result in poor toner.

There is thus a need to provide low melt toners that may be used at lower fusing temperatures that still provide excellent properties, including excellent document offset and heat cohesion. There is also a need to provide a process for preparing such low melt toners that allows for controlled particle growth and controlled morphology or shape, and provides high yields.

SUMMARY

In embodiments, a particle is described that comprises a binder and preferably also a colorant, wherein the binder comprises an amorphous resin and a crystalline resin, wherein the crystalline resin has a melting point of at least about 70° C. and a recrystallization point of at least about 47° C., and wherein the particle is substantially non-crosslinked.

In embodiments, a method of forming particles is described and comprises a binder, a colorant and optionally a wax, comprising the steps of forming the binder of an amorphous polyester resin and a crystalline resin, wherein the crystalline resin has a melting point of at least about 70° C. and a recrystallization point of at least about 47° C., adding the colorant and optionally the wax to the binder.

In embodiments, a further process is described that comprises forming toner particles comprising a binder, a colorant and optionally a wax, wherein the binder comprises an amorphous polyester resin and a crystalline resin, and annealing the toner particles at a temperature within 10° C., and preferably within 5° C., of a recrystallization temperature of the crystalline resin and at or above a glass transition temperature of the crystalline resin.

DETAILED DESCRIPTION OF EMBODIMENTS

A first embodiment relates to a particle, preferably a toner particle, comprising a binder of an amorphous resin and a crystalline resin, wherein the crystalline resin has a melting point of at least 70° C. and a recrystallization point of at least 47° C.

The toner comprising a crystalline resin that has a melting point of at least 70° C. and a recrystallization point of at least 47° C. may be used at lower fusing temperatures. At the same time, the toner exhibits improved document offset properties and improved heat cohesion.

Additives are not necessary to produce the desired results of improved document offset and improved heat cohesion, although additives are not excluded for use in the particles described herein.

Thus, one aspect of this disclosure is directed to a toner comprising a branched amorphous resin and a crystalline sulfonated polyester resin, wherein the crystalline resin has a melting point of at least about 70° C., preferably between about 70° C. and 85° C. such as between about 70° C. and 80° C., and a recrystallization point of at least 47° C., preferably between about 47° C. and 65° C. The document offset and heat cohesion properties can be further improved by annealing the toner at a specified temperature and for specified time. Additionally, in another embodiment, the toner has a minimum fixing temperature from about 120° C. to about 140° C. In a further embodiment, the toner has a fusing latitude from about 50° C. to about 100° C.

Annealing the toner is important such that the semicrystalline resin increases in crystallinity and it's amorphous state is minimized. The crystalline resins described herein typically have a Tg below about 50° C. and, preferably between about 40° C. and about 44° C. This state plasticizes the toner and causes poor cohesion through agglomeration. Annealing at a temperature in the amorphous region or slightly above it, such as the crystallization temperature, allows for the semicrystalline resin to crystallize out. Through tunneling electron microscope (TEM), it is observed that ridges are created near the toner surface after annealing process. It is believed that these ridges are due to the crystalline resin. The differential scanning calorimeter (DSC) also shows an increase in enthalpy of crystallization and a decrease of Tg.

Examples of amorphous resins suitable for use herein include polyester resins, branched polyester resins, polyimide resins, branched polyimide resins, poly(styrene-acrylate) resins, crosslinked, for example from about 25 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins.

The amorphous resin is preferably a branched amorphous sulfonated polyester resin or a linear amorphous sulfonated polyester resin. Branched amorphous sulfonated polyester resins are preferred, for example, when the fuser does not contain a fuser oil or when black or matte prints are desired. Liner amorphous sulfonated polyester resins are preferred, for example, when the fuser include an oil.

Branched amorphous resins can be a polyester, a polyamide, a polyimide, a polystyrene-acrylate, a polystyrene-methacrylate, a polystyrene-butadiene, or a polyester-imide, an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, or an alkali sulfonated polyester-imide, a sulfonated polyester resin, copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly (propoxylated bisphenol A-5-sulfo-isophthalate), copoly(ethoxylated bisphenol-A-fumarate)-copoly(ethoxylated bisphenol-A-5-sulfo-isophthalate), or copoly(ethoxylated bisphenol-A-maleate)copoly(ethoxylated bisphenol-A-5-sulfo-isophthalate).

The branched amorphous polyester resins are generally prepared by the polycondensation of an organic diol, a diacid or diester, a sulfonated difunctional monomer, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. The amount of organic diol selected can vary, and more specifically, is, for example, from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, mixtures thereof, and the like. Effective difunctional monomer amounts of, for example, from about 0.1 to about 2 weight percent of the resin can be selected.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

The amorphous resin is, for example, present in an amount from about 50 to about 90 percent by weight, and more preferably from about 65 to about 85 percent by weight of the binder. Preferably the amorphous resin is a branched amorphous sulfonated polyester resin. The amorphous resin in preferred embodiments possesses, for example, a number average molecular weight (Mn), as measured by gel permeation chromatography (GPC), of from about 10,000 to about 500,000, and preferably from about 5,000 to about 250,000; a weight average molecular weight (Mw) of, for example, from about 20,000 to about 600,000, and preferably from about 7,000 to about 300,000, as determined by GPC using polystyrene standards; and wherein the molecular weight distribution (Mw/Mn) is, for example, from about 1.5 to about 6, and more specifically, from about 2 to about 4.

The crystalline resin may be, for example, a polyester, a polyamide, a polyimide, a polyethylene, a polypropylene, a polybutylene, a polyisobutyrate, an ethylene-propylene copolymer, or an ethylene-vinyl acetate copolymer or a polyolefin. Preferably, the crystalline resins are sulfonated polyester resins.

Examples of a crystalline resin that are suitable for use herein are poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), or poly(octylene-adipate).

The crystalline resin in the toner most preferably displays or possesses a melting temperature of between about 70° C. and 85° C., and a recrystallization temperature of at least about 47° C., and preferably the recrystallization temperature is between about 50° C. and 65° C. Sulfonated polyester resins are most preferred as the crystalline resin herein. The crystalline resin is sulfonated from about 0.5 weight percent to about 4.5 weight percent, and preferably from about 1.5 weight percent to about 4.0 weight percent.

Preferably, the crystalline resin is derived from monomers selected from 5-sulfoisophthalic acid, sebacic acid, dodecanedioic acid, ethylene glycol and butylene glycol. One skilled in the art will easily recognize the monomer can be any suitable monomer to generate the crystalline resin. For example, sebacic acid can be replaced by fumaric acid or adipic acid.

The crystalline resin is, for example, present in an amount of from about 10 to about 50 percent by weight of the binder, and preferably from about 15 to about 40 percent by weight of the binder.

The crystalline resin can possess melting points of, for example, from at least about 70° C., and preferably from about 70° C. to about 80° C., and a number average molecular weight (Mn), as measured by gel permeation chromatography (GPC) of, for example, from about 1,000 to about 50,000, and preferably from about 2,000 to about 25,000; with a weight average molecular weight (Mw) of the resin of, for example, from about 2,000 to about 100,000, and preferably from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resin may be prepared by a polycondensation process of reacting an organic diol and an organic diacid in the presence of a polycondensation catalyst. Generally, a stoichiometric equimolar ratio of organic diol and organic diacid is utilized. However, in some instances, wherein the boiling point of the organic diol is from about 180° C. to about 230° C., an excess amount of diol can be utilized and removed during the polycondensation process.

The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfo-aliphatic diacid can be selected in an amount of from about 1 to about 10 mole percent of the resin.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The colorant in the toner can be a pigment or a dye. The colorant is preferably present in an amount of from about 4 to about 18 weight percent, and more preferably in an amount of from about 3 to about 15 weight percent, of the toner.

Various known suitable colorants, such as dyes, pigments, and mixtures thereof, may preferably be included in the binder, particularly in making toner particles. When present, the colorant may be added in an effective amount of, for example, from about 1 to about 25 percent by weight of the particle, and preferably in an amount of from about 2 to about 12 weight percent. Suitable example colorants include, for example, carbon black like REGAL 330® magnetites, such as Mobay magnetites MO8029™, MO8060 ™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, and Anthrathrene Blue, identified in the Color Index as CI-69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, a wax can be present in an amount of from about 4 to about 12 percent by weight of the particles. Examples of waxes, if present, include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

The resulting particles can possess an average volume particle diameter of about 2 to about 25 microns, preferably from about 3 to about 15 microns, and more preferably from about 5 to about 7 microns. These particles can be formed by either a physical or chemical method. Furthermore, the heat cohesion of the resulting particles is less than about 20%, and more preferably less than 10%.

Another aspect of the present disclosure comprises forming the particles by annealing the particle comprising the crystalline resin at a temperature within about 10° C., and preferably within 5° C., of the recrystallization temperature of the crystalline resin and at or above a glass transition temperature of the crystalline resin. Such annealing improves the heat cohesion and morphology of the particles. Annealing the toner from about 1 hour to about 24 hours, preferably from about 10 hours to about 20 hours, improves heat cohesion. The resulting toner will have a heat cohesion of less than about 20%, and preferably less than 10%.

In addition to improved heat cohesion, annealing the toner provides improved toner morphology. In particular, annealing the toner produces a toner having a ridged surface. The ridged protrusions on the surface of the toner are necessary to result in adequate stripping and improved fusing latitude.

Stripping is the image/substrate releasing from the fuser roll in a timely fashion. If the if the recording medium, e.g., sheet of paper, with the toner sticks to the fuser roll it will be in contact with the fuser roll at elevated temperatures for extended periods of time and either begin to hot offset or cause variations in gloss. In extreme case of poor stripping, the recording medium will wrap around the fuser roll. Good stripping will also minimize the occurrence of paper jams.

A toner having a ridged surface improves cleaning of residual toner from the photoreceptor. If the toner is too round, the blade cleaners are not very effective.

The following Examples are being provided to further illustrate various species of the present disclosure, it being noted that these Examples are intended to illustrate and not limit the scope of the present disclosure.

Example 1

A series of crystalline homopolyester resins and crystalline copolyester resins were prepared with 2% sulfonation level as listed below in Table 1. The first three resins were crystalline homopolyester resins. The first crystalline homopolyester resin was derived from sebacic acid (C10) and ethylene glycol (C2), the second resin was derived from dodecanedioic acid (C12) and ethylene glycol (C2), and the third crystalline homopolyester resin was derived from dodecanedioic acid (C12) and butylenes glycol (C4). The four crystalline copolyester resins were derived from a mixture of sebacic acid, dodecanedioic acid and ethylene glycol. One skilled in the art will easily recognize the homopolyester can be derived from any suitably monomers. For example, sebacic acid can be replaced by fumaric acid or adipic acid.

TABLE 1

Crystalline Homopolyester Resins and Crystalline Copolyester Resins

| ENTRY | RESIN | MELTING POINT (° C.) $1^{ST}/2^{ND}$ Scan | Re-Crystallization (° C.) |
|---|---|---|---|
| 1 | C10-C2 | 69.8/68.4 | 44.5 |
| 2 | C12-C2 | 83/78.7 | 59.6 |
| 3 | C12-C4 | 70/73 | 52 |
| 4 | C10/C12(10/90)-C2 | 78.3/75.1 | 59.8 |
| 5 | C10/C12(15/85)-C2 | 78.5/74.7 | 59.1 |
| 6 | C10/C12(20/80)-C2 | 733.9/74 | 51 |
| 7 | C10/C12(25/75)-C2 | 70.6/68 | 52 |

Typically, resins will change melting points over time due to crystallization. Thus, a second scan is reported.

A series of ultra low melt toners were generated including the crystalline resins. The generated toners comprised 5% cyan 15:3, 9% carnauba wax, 64.5% branched sulfonated polyester resin and 21.5% crystalline resin chosen from Table 1. The ratio of branched amorphous resin to crystalline resin was 75:25. The toner particles were coalesced at 70° C. The toner slurry was then allowed to self cool to room temperature.

The fusing performance of the toners was then tested using an oil-less fuser. The results of which are detailed below in Table 2. MFT refers to minimum fixing temperature. Both toner to toner (T/T) document offset and toner to paper (T/P) document offset were measured.

TABLE 2

| Ultra Low Melt Toners | | | | | | | |
|---|---|---|---|---|---|---|---|
| | | | LATI- | GLOSS at 180° | DOCUMENT OFFSET | | COHE- |
| TONER | RESIN | MFT | TUDE | C. | T/T | T/P | SION |
| I | 1 | 128 (F.-31) | 57 | 73 | 4.5 | 1.5 | 78% |
| II | 2 | 146 (F.-15) | 64 | 49.6 | 4.5 | 4.5 | 17.5% |
| III | 3 | 162 (F.-1) | 33 | 33 | 4.5 | 4.5 | 28% |
| IV | 4 | 148 (F.-14) | 62 | 53.8 | 4.5 | 4.5 | 14.2% |
| V | 7 | 141 (F.-21) | 69 | 43 | 4.5 | 4.5 | 68.1% |

(F.-*) describes the temperature difference between the fusers MFT of the low melt toner compared to a control toner, i.e., one without crystalline resin.

Fusing latitude is the difference in temperature between the MFT and Hot-offset temperature. The significance is that the fuser rolls will vary in temperature up to 40-50° C. Thus, we need a certain latitude so that the toner does not offset in case the fuser roll fluctuates in temperature.

In cases where the heat cohesion was greater than 50%, the toner was annealed and fusing performance was again tested using an oil-less fuser. The cohesion of Toner I improved to 45% while the cohesion of Toner V improved to 17%. Annealing the toners did not affect any of the other factors of toner performance.

The document offset, both toner to toner offset and toner to paper offset, of all toners with a crystalline resin exhibiting a re-crystallization point of at least 50° C., was excellent. An improvement in toner cohesion was also observed. Annealing the toner further improved heat cohesion.

Toners derived from higher melting crystalline resins exhibit an increased MFT. Thus, Toner V was optimized by increasing the crystalline resin in the formulation of the toner to lower the MFT. The ratio of the branched amorphous resin to crystalline resin was changed to a ratio of 65:35 from 75:25, resulting in Toner VI. Fusing, document offset and charging met general toner specifications as demonstrated in Table 3 below.

The crystalline resin lowers the MFT due to the sharp melting and low viscosity compared to an amorphous resin. Also, the resin is very hard (ductile) at room temperature with high mechanical strength (i.e., it does not fracture as easily as amorphous resins).

TABLE 3

| Ultra Low Melt Toner with Increased Crystalline Resin | | | | | | | | |
|---|---|---|---|---|---|---|---|---|
| | | | Lati- | Gloss @180° | Document Offset | | Charg-ing | Cohe- |
| Toner | Resin | MFT | tude | C. | T/T | T/P | A/C | sion |
| VI | 7 | 130 (F.-33) | 60 | 47 | 4.5 | 4.5 | −3.0/ −9.0 | 31% |

Example 2

As annealing improved the heat cohesion of a toner in Example 1, an emulsion/aggregation toner was annealed at a temperature corresponding to its recrystallization temperature of the crystalline resin to increase the crystalline content of the toner and improve the heat cohesion of the toner.

It is theorized that cooling the toner at room temperature causes the crystalline component to solidify in an amorphous state with a low Tg, thus causing poor cohesion. Accordingly, it is believed that annealing the toner results in greater crystallization of the crystalline resin which causes ridges on the toner surface.

An ultra low melt toner comprising a crystalline resin derived from sebacic acid and ethylene glycol was prepared in the same manner as Toner I from Example 1. A portion of the toner was then immediately quenched by discharging into a container of cold water. The remaining toner was slowly cooled to room temperature. The toner was cooled at a rate of about 0.1° C. per hour.

According to a differential scanning calorimeter (DSC), a higher amount of crystalline content was observed in the slow cooled toner compared to the quenched toner. Furthermore, the slow cooled toner was found to contain ridges on the particle surface.

Annealing the toner also greatly improved its heat cohesion. The heat cohesion of the quenched toner was approximately 95%, while the heat cohesion of the slow cooled toner was found to be improved to approximately 38%.

In order to optimize the annealing time and temperature, the toner was annealed for 1, 5 and 10 hours at 35° C., 40° C., 45° C. and 50° C. It was found that the optimum annealing temperature was greater than 45° C. and for a length of time greater than or equal to 10 hours.

A scale-up of the ultra low melt toner with a recrystallization point of about 45° C. was annealed overnight, i.e., approximately 17 hours at three temperatures, e.g., 35° C., 45° C. and 50° C. The result are shown below in Table 4. The optimum cohesion was attained at 45° C., which corresponds to within 5° C. of the recrystallization temperature of the crystalline resin in the toner. Furthermore, the toner has the added advantage of a ridged surface.

TABLE 4

| Toner Annealing | | |
|---|---|---|
| Sample | Annealing | Cohesion |
| 1 | None | 77% |
| 2 | 35° C. | 51% |
| 3 | 45° C. | 37% |
| 4 | 50° C. | 58% |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A toner particle comprising a binder, wherein the binder comprises an amorphous sulfonated polyester resin and a crystalline sulfonated polyester or sulfonated copolyester resin, the toner particle is annealed at a temperature within about 10° C. of a recrystallization point and at or above a glass transition temperature of the crystalline sulfonated polyester or sulfonated copolyester resin, and the crystalline resin has a melting point of at least about 70° C. and a recrystallization point of at least about 47° C., wherein the annealed toner particle has a ridged surface.

2. The toner particle according to claim 1, wherein the recrystallization point is from about 47° C. to about 65° C.

3. The toner particle according to claim 1, wherein a ratio of the amorphous resin to the crystalline resin is about 50:50 by weight to about 90:10 by weight.

4. The toner particle according to claim 1, wherein the toner particle further comprises a colorant.

5. The toner particle according to claim 1, wherein the toner particle further comprises a wax.

6. The toner particle according to claim 1, wherein the toner particle has a heat cohesion value following annealing of less than about 20%.

7. The toner particle according to claim 1, wherein the toner particle has a minimum fixing temperature from about 120° C. to about 140° C.

8. The toner particle according to claim 1, wherein the toner particle has a fusing latitude from about 50° C. to about 100° C.

9. The toner particle according to claim 1, wherein the crystalline resin is present in an amount of from about 10% to about 50% by weight of the binder.

10. The toner particle according to claim 1, wherein the amorphous resin is present in an amount of from about 50% to about 90% by weight of the binder.

11. The toner particle of claim 1, wherein the amorphous resin possess a number average molecular weight (Mn) of from about 10,000 to 500,000, and a weight average molecular weight of from about 20,000 to about 600,000, and wherein the molecular weight distribution (Mw/Mn) is from about 1.5 to 6.

12. The toner particle according to claim 1, wherein the crystalline sulfonated polyester resin or sulfonated copolyester resin is derived from monomers selected from the group consisting of 5-sulfoisophthalic acid, sebacic acid, dodecanedioic acid, ethylene glycol and butylene glycol.

13. The toner particle according to claim 1, wherein the melting point is from about 70° C. to about 80° C.

14. A toner particle comprising a binder, wherein the binder comprises an amorphous sulfonated polyester resin and a crystalline sulfonated polyester or sulfonated copolyester resin, the toner particle is annealed at a temperature within 10° C. of a recrystallization point and at or above a glass transition temperature of the crystalline sulfonated polyester or sulfonated copolyester resin, and the crystalline resin has a melting point of from about 70° C. to about 85° C. and a recrystallization point of from about 47° C. to about 65° C., wherein the toner particle further comprises a colorant, and wherein the annealed toner particle has a ridged surface.

15. The toner particle according to claim 14, wherein the amorphous resin is present in an amount of from about 50% to about 90% by weight of the binder, and the crystalline resin is present in an amount of from about 10% to about 50% by weight of the binder.

* * * * *